United States Patent [19]

Allen et al.

[11] Patent Number: 4,887,825

[45] Date of Patent: Dec. 19, 1989

[54] SKATEBOARD

[76] Inventors: D. Mason Allen; Ashton D. Allen, both of 119 Spring Valley Loop, Altamonte Springs, Fla. 32714

[21] Appl. No.: 858,117

[22] Filed: May 1, 1986

[51] Int. Cl.[4] ..... A63C 7/14

[52] U.S. Cl. ..... 280/87.042; 16/115; 242/107; 280/809; 441/65; 441/75

[58] Field of Search ..... 16/114 B, 115; 242/107; 441/65, 75; 280/12 H, 87.04 R, 87.04 A, 87.042, 809

[56] References Cited

U.S. PATENT DOCUMENTS

| | | | |
|---|---|---|---|
| 1,150,773 | 8/1915 | Chall | 280/87.04 A |
| 1,531,585 | 3/1925 | Walton | 280/87.04 A |
| 3,198,300 | 8/1965 | Tuttle | 242/107 X |
| 3,455,261 | 7/1969 | Perrin | 441/65 X |
| 3,982,613 | 9/1976 | Wood | 242/107 X |
| 4,025,082 | 5/1977 | Lummus | 280/12 H |
| 4,040,639 | 8/1977 | Scardenzan | 280/87.04 A |
| 4,073,500 | 2/1978 | Campeau | 280/87.04 R |
| 4,179,134 | 12/1979 | Atkinson | 280/11.2 X |
| 4,289,325 | 9/1981 | Whitacre | 280/87.04 A |

*Primary Examiner*—Charles A. Marmor
*Assistant Examiner*—Michael Mar
*Attorney, Agent, or Firm*—William M. Hobby, III

[57] ABSTRACT

A skateboard apparatus is adapted to be held against the riders feet when the rider is performing maneuvers on the skateboard. The skateboard has an elongated platform having a pair of wheel trucks thereof. A flexible cord is attached through a center aperture in the platform to the bottom of the platform and has a handle attached to the end extending through the platform, so that a rider can pull on the handle to hold the skateboard against his feet when performing maneuvers. A spring loaded reel may be attached to the platform underside between the skateboard wheel trucks. The platform aperture may include a self-lubricating grommet for the cord to pass through.

3 Claims, 1 Drawing Sheet

SKATEBOARD

BACKGROUND OF THE INVENTION

The present invention relates to a skateboard, and especially to a skateboard which can be held against the riders feet while the rider is performing maneuvers on the skateboard.

Skateboards have been in existence for many years, but in recent years have been developed to provide an extremely precise and skillful art. The boards normally consist of an elongated platform, having a pair of wheel truck assemblies attached to the bottom thereof with wheels attached thereto. The trucks are designed, such that, the rider of the skateboard can perform a wide variety of intricate maneuvers and obtain extremely high speeds. In addition, the boards are extremely durable to resist damage thereto, even at high speed or during severe impact when performing maneuvers. Normally the difficulties in performing with prior skateboards, has been due to the fact that the operator has contact with the skateboard only with his feet. This limits the operators coordination of the body and skateboard when doing maneuvers, such as where the entire skateboard and rider leave the surface, or whenever the front or rear wheels leave the surface which the board is rolling upon.

The present invention is adapted to allow the rider to hold the board against both feet during all types of maneuvers when the front or rear wheels are off the roller surface and when both sets of wheels are off the surface.

Prior art skateboards have provided various types of handles attached to flexible lines or to rigid upright members. These prior art hand supports are attached to the front of the skateboard, such as shown in the Whitacre U.S. Pat. No. 4,289,325 to give the rider support and to allow the rider to lift the front end of the skateboard. U.S. Pat. No. 4,179,134 to Atkinson provides for a removable trainer handle and brake for a skateboard in which a handle is attached to a rigid upright member attached to the front portion of the skateboard. In U.S. Pat. No. 4,073,500 to Campeau, a wheel board of a different type has a rigid handle extending from the front to the back of the board. The closest prior art to the present invention may be seen in the Scardenzan, U.S. Pat. No. 4,040,639 for a skateboard which incorporates a special braking device at the rear end thereof for safety purposes and provides for a flexible line to be tethered to the forward end which may be grasped by the rider and in connection with the foot allows the skateboard to be pulled forward to push the braking device against the rolling surface. In one embodiment, a retractable reel is used to allow the extension of the forwardly supported line. This patent is directed towards a different purpose than the present invention, in that, the cord needs to be attached as far forward as possible to allow the skateboard to be pulled forward to push the brake surface against the roller surface and cannot be used for supporting a skateboard platform against both feet of the rider during intricate maneuvers. This board, in fact, has a foot binding attached thereto, to assist in the operation and support of one of the feet to the board.

SUMMARY OF THE INVENTION

A skateboard apparatus is adapted to be held against the rider's feet when performing maneuvers on the skateboard. The skateboard has an elongated platform having a top rider surface and an underside surface, as well as front, rear and center portions thereof. The skateboard also has a pair of wheel truck assemblies attached to the underside of the platform with one of the wheel truck assemblies being attached to the front portion of the platform and the other being attached to the rear portion of the platform. The flexible cord is attached to the center portion of the platform to the bottom of the platform on one end and has a handle attached to the other end thereof, with the cord being of a length to be supported with a rider's extended arms. A spring loaded reel may be attached to the bottom of the platform between the skateboard wheel trucks to allow the cord to be retracted when not being used. In addition, the aperture passing through the center of the skateboard platform may have a lubricating grommet for the cord to pass through without excessive wear.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
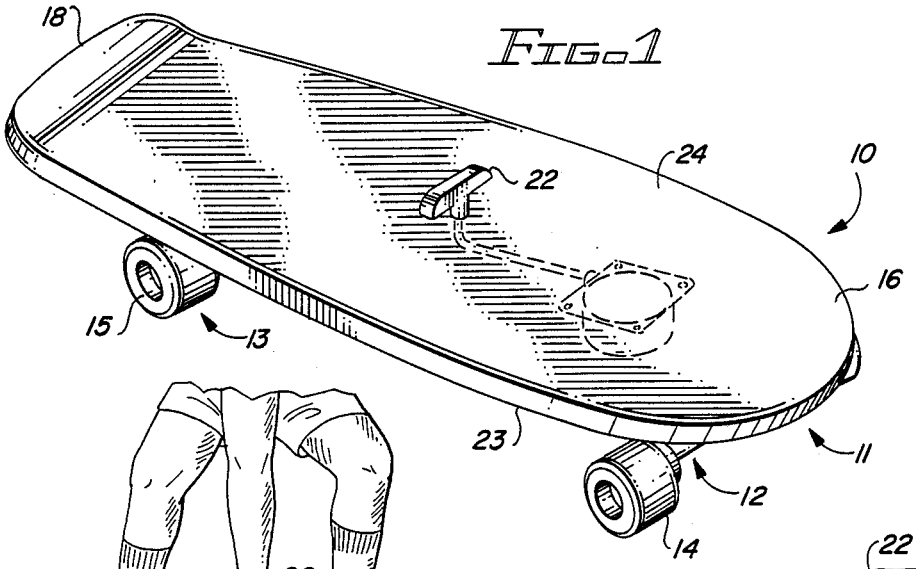
FIG. 1 is a perspective view of a skateboard in accordance with the present invention.

Referring to the drawings, a skateboard 10 is shown having a platform 11 and a front truck assembly 12 and a rear truck assembly 13. The front truck assembly has wheels 14 attached thereto, while the rear truck assembly has wheels 15 attached thereto. The skateboard platform 11 has a front portion 16, a center portion 17 and a rear portion 18. An aperture 20 passes through the center portion of the platform 11 and allows a cord 21 to extend therethrough. The cord 21 has a handle 22 attached thereto and is attached to the underside 23 of the skateboard 11, while the handle 22 is located over the riders upper side 24 of the platform 11. A retractable reel 25 is bolted to the underside of the platform 11 with screws 26 and has an opening 27 extending therefrom for the cord 21 to extend therethrough and through the aperture 20. The aperture 20 has a grommet 28 protecting the opening which grommet may be a metal grommet or may be a self-lubricating polymer such as a nylon or Teflon grommet to protect the cord 21 being pulled back and forth therethrough, as well as to prevent wear on the aperture 20.

Figure 3:
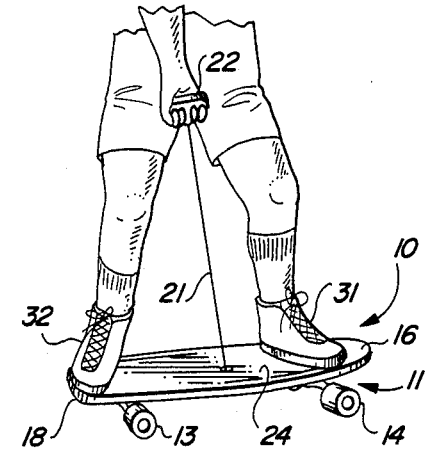
FIG. 3 is a perspective view of a skateboard in accordance with FIG. 2 in which the rider has the handle and cord extended through the center opening on the skateboard.
Figure 4:
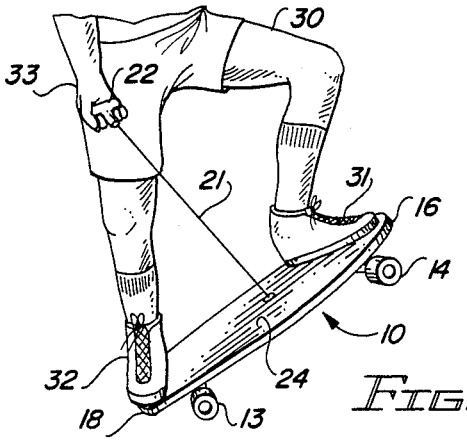
FIG. 4 is a perspective view of a skateboard in accordance with FIGS. 1 thru 3 during a maneuver.

A rider 30 is shown with his front foot 31 and rear foot 32 on the top surface 24 of the platform 11 with the rider reaching down and grasping the handle 22 with his hand 33 and pulling the cord 21 through the aperture and grommet 28 to his extended position as shown in FIG. 3, then performing maneuvers in which both feet 31 and 32 are held against the platform 11 by pulling on the handle 22 and cord 21.

Figure 2:
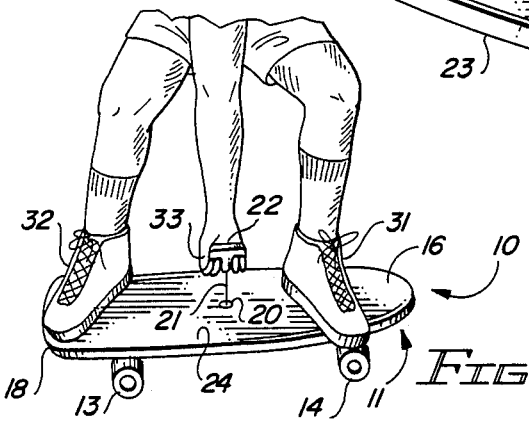
FIG. 2 is a partial perspective view of a skateboard in accordance with claim 1 with a rider thereon grasping the cord handle.
Figure 5:
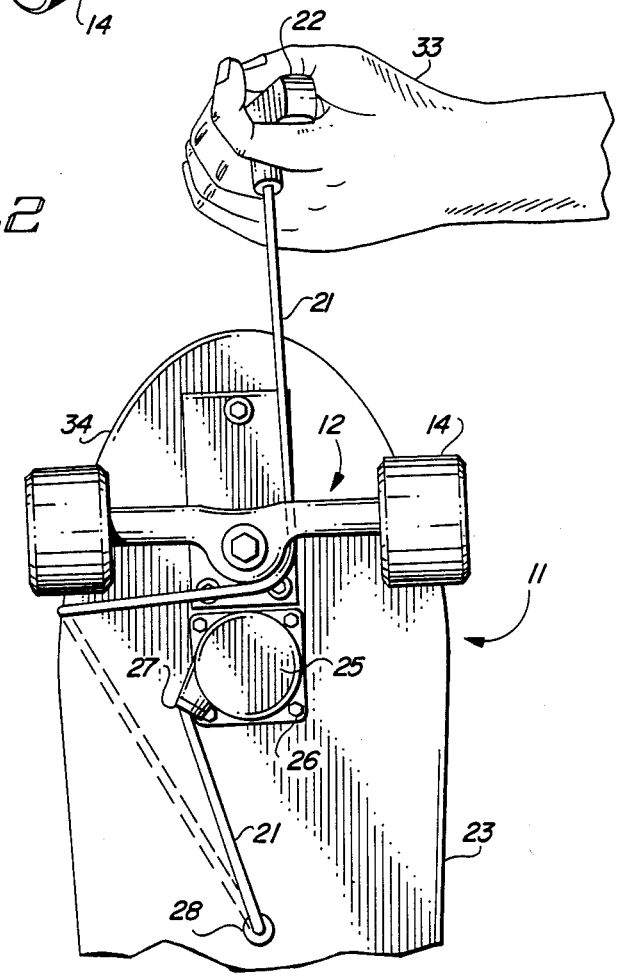
FIG. 5 is a bottom elevation of the front portion of a skateboard of FIGS. 1 thru 4 having the cord connected for toting the skateboard.

FIG. 5 shows the cord 21 extended from the top side 24 of the platform 11 around the edge 34 and around a portion of the front truck 12 and then used with the handle 22 held by the rider's hand 33 to tote the skateboard from place to place. In operation, the rider may use the skateboard in normal fashion, or if performing intricate maneuvers, can reach down and grab the handle 22, as shown in FIG. 2 and extend the cord 21 as shown in FIG. 3 for performing the maneuvers, especially those maneuvers that require both wheels to be lifted off the surface, or which require the rear wheels to be lifted off, rather than the front wheels.

It should be clear at this point that a skateboard, specially adapted for intricate maneuvers, has been provided with an extendible cord extending from the middle of the skateboard, from the bottom of the skateboard. It should, however, be clear that the present invention is not to be limited to the forms shown, which are to be considered illustrative rather than restrictive.

We claim:

1. A skateboard adapted to be held against the rider's feet when performing maneuvers on the skateboard comprising;

a skateboard having an elongated platform having a rider's surface and an underside surface and front, rear and center portions, said skateboard also having a pair of wheel truck assemblies attached to the underside of said platform, one wheel truck assembly being attached to the front portion of said platform and the other being attached to the rear portion of the said platform;

a flexible cord attached through an aperture in the center portion of said platform to the bottom of said platform and having a handle attached to the other end thereof, said cord being of a length to be supported with a rider's extended arm, whereby said skateboard platform can be held against the rider's feet when performing skateboard maneuvers;

a spring loaded reel attached to the platform underside between said skateboard wheel truck assemblies, said flexible cord being retractably attached to said retractable reel and extending through an opening therein, said opening facing generally towards the aperture on the center of said platform; and said skateboard platform aperture having a grommet therein to protect the cord from undue abrasion.

2. A skateboard in accordance with claim 1, in which said grommet is a lubricating polymer material.

3. A skateboard in accordance with claim 2, in which said grommet is nylon.

* * * * *